US008292290B2

(12) United States Patent
Ishii

(10) Patent No.: US 8,292,290 B2
(45) Date of Patent: Oct. 23, 2012

(54) FEEDING DEVICE AND IMAGE FORMING APPARATUS

(75) Inventor: Satoru Ishii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 63 days.

(21) Appl. No.: 12/905,903

(22) Filed: Oct. 15, 2010

(65) Prior Publication Data

US 2011/0241286 A1 Oct. 6, 2011

(30) Foreign Application Priority Data

Apr. 6, 2010 (JP) ..... 2010-087473

(51) Int. Cl.
*B65H 1/00* (2006.01)

(52) U.S. Cl. ..... 271/171; 271/9.01

(58) Field of Classification Search ..... 271/171, 271/145, 9.01, 9.08, 9.09, 9.13, 162; 399/393
See application file for complete search history.

(56) References Cited

U.S. PATENT DOCUMENTS

2002/0084576 A1* 7/2002 Kim ..... 271/145
2003/0227127 A1* 12/2003 Chang ..... 271/171

FOREIGN PATENT DOCUMENTS

JP 2005-119872 * 5/2005
JP 2006-124147 A 5/2006
JP 2006-327798 A 12/2006
JP 2007-197098 A 8/2007
JP 2009-155006 A 7/2009

* cited by examiner

*Primary Examiner* — Gerald McClain
*Assistant Examiner* — Thomas Morrison
(74) *Attorney, Agent, or Firm* — Sughrue Mion, PLLC

(57) ABSTRACT

A feeding device includes a body having a sheet placement surface on which a sheet that is to be fed is placed; a cover rotatably provided at the body and supporting a back edge portion in a feeding direction of the sheet placed on the sheet placement surface when the cover is open; a moving member provided at the sheet placement surface so as to be movable in a direction parallel to the feeding direction; a linking member extending in a movement direction of the moving member from the moving member, one end portion thereof being rotatably linked to the moving member using a rotary shaft that is parallel to a rotary shaft of the cover; and a sheet back-edge regulating member provided at the linking member so as to be movable in the movement direction, and regulating a back edge in the feeding direction of the sheet.

10 Claims, 14 Drawing Sheets

FEEDING DEVICE AND IMAGE FORMING APPARATUS

CROSS-REFERENCE TO RELATED APPLICATIONS

This application is based on and claims priority under 35 USC 119 from Japanese Patent Application No. 2010-087473 filed Apr. 6, 2010.

BACKGROUND

Technical Field

The present invention relates to a feeding device and an image forming apparatus.

SUMMARY

According to an aspect of the invention, there is provided a feeding device including a body having a sheet placement surface on which a sheet that is to be fed is placed; a cover rotatably provided at the body, capable of supporting a back edge portion in a feeding direction of the sheet when the cover is open, and being provided with a rotary shaft, the sheet being placed on the sheet placement surface; a moving member provided at the sheet placement surface so as to be movable in a direction that is parallel to the feeding direction; a linking member extending in a direction of movement of the moving member from the moving member, one end portion of the linking member being rotatably linked to the moving member using a rotary shaft that is parallel to the rotary shaft of the cover; and a sheet back-edge regulating member provided at the linking member so as to be movable in the direction of movement of the moving member, and regulating a back edge in the feeding direction of the sheet placed on the sheet placement surface.

BRIEF DESCRIPTION OF THE DRAWINGS

An exemplary embodiment of the present invention will be described in detail based on the following figures, wherein.

DETAILED DESCRIPTION

An exemplary embodiment of the present invention will hereunder be described with reference to the drawings.

(1) Basic Structure and Operation of Printer

First, a basic structure and operation of a printer (image forming apparatus) according to an exemplary embodiment will be described.

Figure 1:
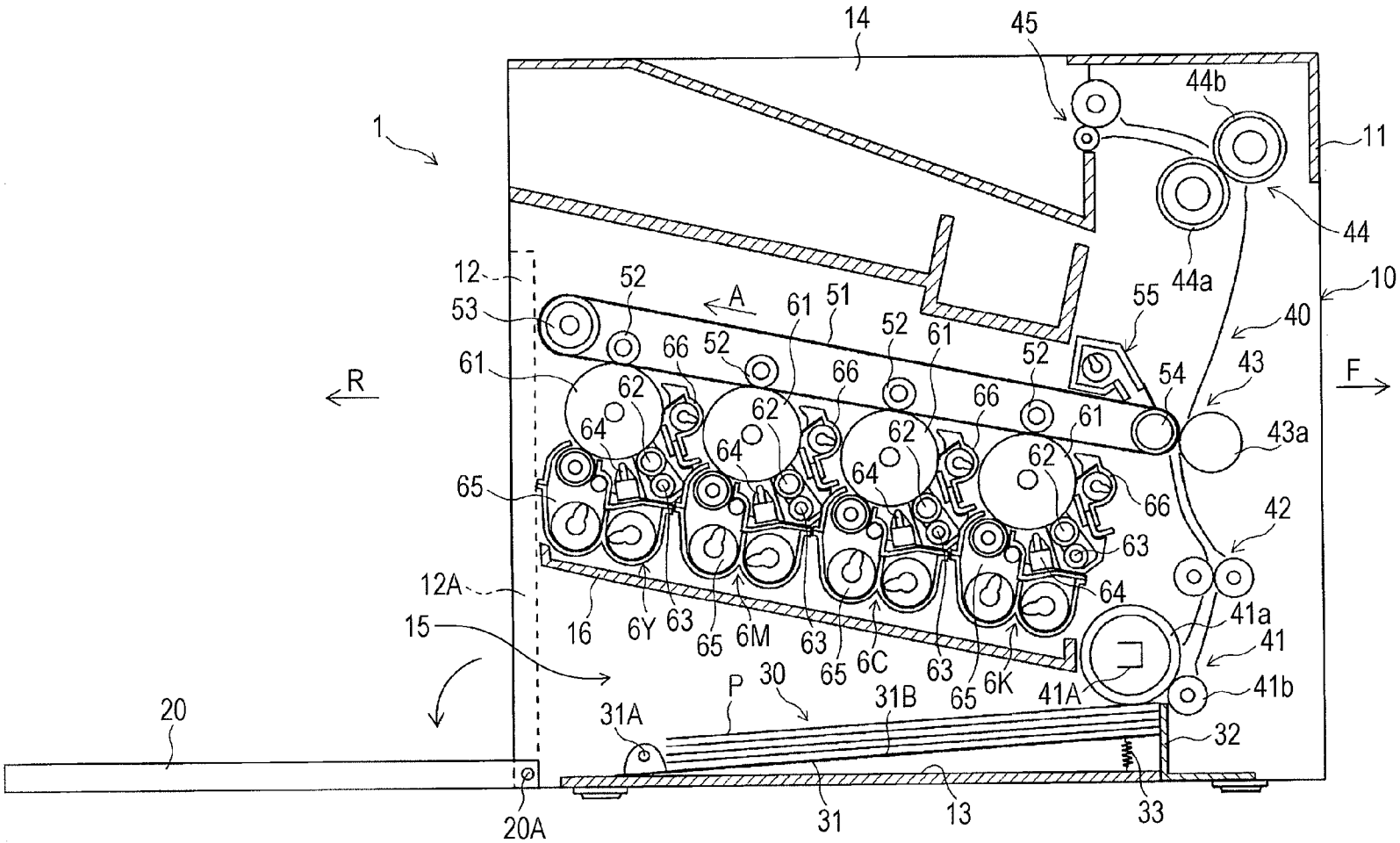
FIG. 1 is a side view of an internal structure of a printer according to an exemplary embodiment of the present invention.

FIG. 1 is a schematic view of an internal structure of a printer 1 according to an exemplary embodiment of the present invention. In FIG. 1, reference numeral 10 denotes a body including a housing 11. A back side of the body 10 (in the direction of arrow R in FIG. 1) is open. This opening 12 is covered and uncovered using a cover 20. In the description below, a front-back direction and an up-down direction refer to directions in the body 10 where the direction R is a direction towards the back and a direction F is a direction towards the front. A lower end of the cover 20 is hinged to the body 10 with a hinge shaft (a rotary shaft of the cover) extending in a left-right direction (a direction towards or away from a viewer of FIG. 1). The cover 20 is opened and closed by tilting the cover 20 in the front-back direction.

A bottom portion of the body 10 is provided with a feed tray 30. The feed tray 30 includes a sheet loading plate 31 and a standing plate section 32. A back edge portion of the sheet loading plate 31 is hinged to a bottom plate section 13 of the body 10 with a rotary shaft 31A. The standing plate section 32 is disposed at the front side of the sheet loading plate 31, and is secured to the bottom plate section 13. The sheet loading plate 31 is biased so as to rotate upward around the rotary shaft 31A as a fulcrum by a coil spring 33 secured to the bottom plate section 13. The upper surface of the sheet loading plate 31 is a sheet placement surface 31B on which sheets is capable of being placed. A large number of sheets P are loaded on the sheet placement surface 31B. Regulating plates 34 that slide in synchronism in the left-right direction and that contact respective edges of the sheet P to position a sheet widthwise position to the center of the sheet placement surface 31B are provided at respective sides of the sheet placement surface 31B.

The sheets P that are loaded upon the sheet placement surface 31B and whose widthwise positions are determined by the regulating plates 34 are drawn out upward one sheet at a time from an upper sheet by a sheet draw-out section 41, move upward along a sheet transport path 40 formed at the front side of the interior of the body 10, and are discharged to a paper output tray 14 formed at the upper side of the body 10.

The printer 1 is a tandem full-color printer. The interior of the body 10 includes, for example, a transfer belt 51, image forming units 6Y, 6M, 6C, and 6K of four colors, a second transfer section 43, and a fixing section 44. The transfer belt 51 is stretched so as to be rotatable and upwardly inclined towards the back (that is, upwardly inclined towards the left in FIG. 1). The transfer belt 51 rotates in the direction of arrow A. The image forming units 6Y, 6M, 6C, and 6K are disposed in parallel with each other below the transfer belt 51, and in parallel with an inclination direction of the transfer belt 51. A partition plate 16 is disposed below the image forming units 6Y, 6M, 6C, and 6K so as to oppose the image forming units 6Y, 6M, 6C, and 6K, with a space 15 being formed between the sheet loading plate 31 and the partition plate 16. The partition plate 16 is provided parallel with the inclination direction of the transfer belt 51 below the image forming units 6Y, 6M, 6C, and 6K.

The four image forming units 6Y, 6M, 6C, and 6K form a yellow (Y) toner image, a magenta (M) toner image, a cyan (C) toner image, and a black (B) toner image, respectively, and have the same basic structure. The four image forming units 6Y, 6M, 60, and 6K each include a photoconductor drum 61, a charging roller 62, a charging roller cleaner 63, an image exposure device 64, a developing unit 65, and a photoconductor drum cleaner 66. The charging rollers 62, the charging roller cleaners 63, the image exposure devices 64, the developing units 65, and the photoconductor drum cleaners 66 are disposed around their respective photoconductor drums 61.

When color image information is input to the printer 1 from, for example, a personal computer, four light beams corresponding to the respective colors exit from the image exposure devices 64. The light beams scan the surfaces of the photoconductor drums 61 that are charged by the charging rollers 62 and that rotate. This causes electrostatic latent images to be formed on the surfaces of the respective photoconductor drums 61.

The electrostatic latent images formed on the respective photoconductor drums 61 are developed with developers including toners of the respective colors by the respective developing units 65. The developed toner images (color images) are subjected to first transfer operations by first transfer rollers 52 so as to be transferred onto a surface (outer peripheral surface) of the rotating transfer belt 51. The first transfer operations of the developed images from the photoconductor drums 61 to the transfer belt 51 are sequentially performed at predetermined timings at the respective image forming units 6Y, 6M, 6C, and 6K. When the transfer belt 51 passes the black image forming unit 6K disposed at the downstreammost side, a full color toner image is formed on the surface of the transfer belt 51.

Although residual material, such as toner or a discharge product, may be adhered to the surface of each photoconductor drum 61 after the first transfer operation, any residual material is removed by the corresponding photoconductor drum cleaner 66. The surface of each photoconductor drum 61 is re-charged by its corresponding charging roller 62. Any residual material that is adhered to any charging roller 62 because the residual material is not completely removed by the corresponding photoconductor drum cleaner 66 is removed by its corresponding charging roller cleaner 63 that contacts the charging roller 62 and rotates.

The transfer belt 51 is wound around a driving roller 53 and a backup roller 54, and rotates in the direction of arrow A by rotation of the driving roller 53. The first transfer rollers 52 are disposed at the inner side of the transfer belt 51. The first transfer rollers 52 and the photoconductor drums 61 of the respective image forming units 6Y, 6M, 6C, and 6K form nips that nip the transfer belt 51.

At the second transfer section 43, the full-color toner image formed on the transfer belt 51 is transferred onto a sheet P that is drawn out from the feed tray 30 by the sheet draw-out section 41 and that moves upward along the sheet transport path 40 at a proper timing. The sheet draw-out section 41 includes a feed roller 41*a* and a sheet separating roller 41*b*. The sheets P are separated one at a time by the sheet draw-out section 41, are drawn out towards the front, are temporarily transported to a pair of registration rollers 42 (disposed above the sheet draw-out section 41), and are stopped. Then, the pair of registration rollers 42 that are rotationally driven at a predetermined timing send the sheets P to the second transfer section 43.

The second transfer section 43 includes the backup roller 54 where the transfer belt 51 is stretched, and a second transfer roller 43*a* that forms a nip with the backup roller 54. When the sheet P passes between the rollers 54 and 43*a*, the full-color toner image on the transfer belt 51 is transferred to the sheet P. Residual material, such as toner, may adhere to the surface of the transfer belt 51 after the second transfer. However, the residual material is removed by a transfer belt cleaner 55 disposed above a front end portion of the transfer belt 51.

The fixing section 44 is where the full-color toner image is fixed to the sheet P that has the full-color toner image transferred thereto and that passes the fixing section 44. The fixing section 44 includes a heating roller 44*a* and a pressure roller 44*b* that forms a nip with the heating roller 44*a*. When the sheet P passes between the rollers 44*a* and 44*b*, the full-color toner image is fixed to the sheet P by pressure bonding and heating. The sheet P that has passed the fixing section 44 is discharged to the paper output tray 14 by a pair of discharge rollers 45. The sheet transport path 40 is a path extending from the sheet draw-out section 41 to the pair of discharge rollers 45 through the pair of registration rollers 42, the second transfer section 43, and the fixing section 44.

Since the partition plate 16 is parallel with the transfer belt 51 and is inclined upward and backward, the space 15 becomes wider in the up-down direction towards the back. In addition, a portion of the opening 12 that communicates with the space 15 is a sheet supply opening 12A used to supply the sheet onto the sheet loading plate 31 of the feed tray 30. The sheet supply opening 12A and the feed tray 30 are covered and uncovered using the cover 20.

Figure 2:
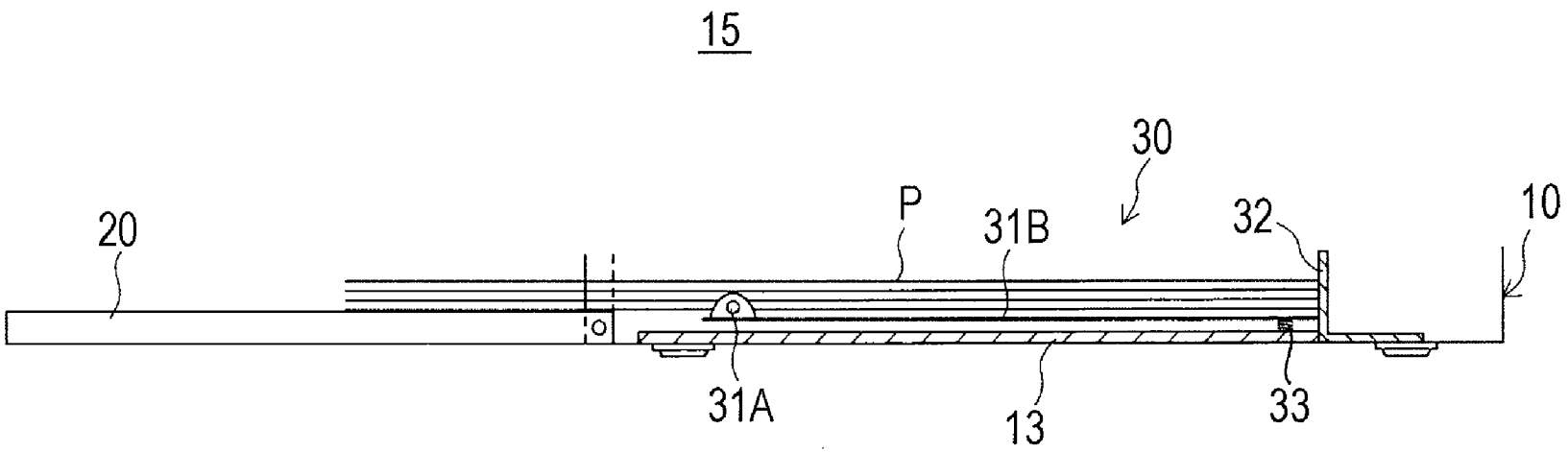
FIG. 2 is a side view of a feed tray and a cover of the printer, and shows a state in which back edge portions of large sheets held on the feed tray are disposed on the open cover.

When the sheet P is transported to form an image, as shown in FIG. 1, the sheet loading plate 31 is raised upward by the coil spring 33, and the upper side of an edge of the sheet P press-contacts the lower surface of the feed roller 41*a* of the sheet draw-out section 41, so that the sheet P is capable of being drawn out by the sheet draw-out section 41. In contrast, at times other than when an image is formed, a back end portion of the sheet loading plate 31 is pushed downward against the coil spring 33 by eccentric cams 41B (see FIG. 3) that rotate together with the feed roller 41*a*. Then, as shown in FIG. 2, the back end portion of the sheet loading plate 31 is positioned at a sheet supply position where it becomes parallel with the bottom plate section 13.

The sheet P is supplied onto the sheet loading plate 31 from the sheet supply opening 12A while the sheet loading plate 31 is positioned at the sheet supply position. The sheet P is inserted until its edge abuts upon the standing plate section 32, and is loaded onto and held by the sheet loading plate 31. In the printer 1, as shown in FIG. 2, while the cover 20 is completely opened and set horizontally, and the back edge of the sheet P is loaded on and supported by an upwardly facing inner surface of the cover 20, a sheet P having a length that is larger than the depth of the feed tray 30 is capable of being supplied onto the sheet loading plate 31 of the feed tray 30.

(2) Structure of Feed Tray

Figure 3:
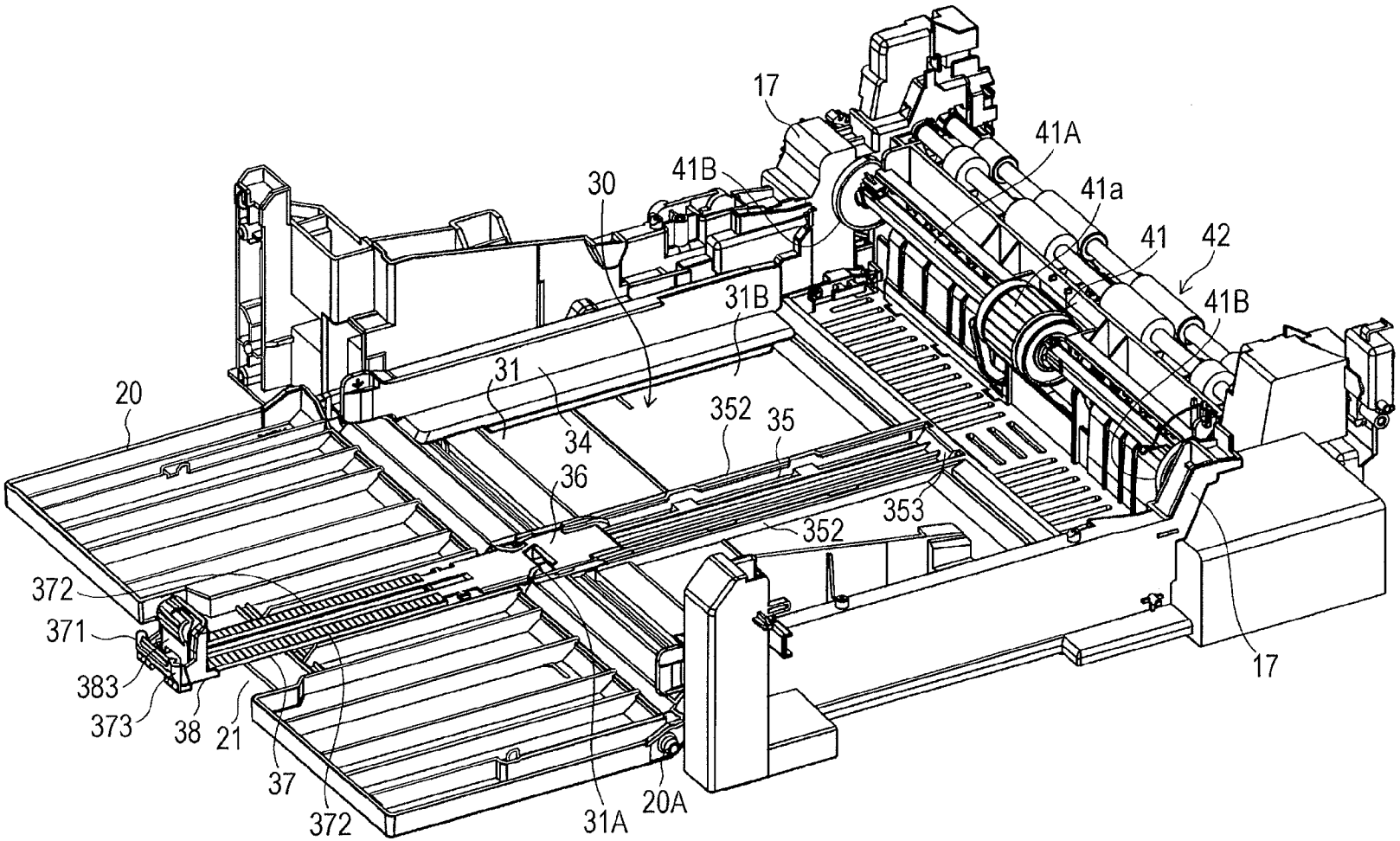
FIG. 3 is a perspective view of a bottom portion of the printer, and shows a state in which the cover is open and an arm and a slide plate are disposed at backmost positions.

Next, the feed tray 30 will be described in detail. FIG. 3 shows the feed tray 30 (including the sheet loading plate 31), the cover 20, the feed roller 41*a*, and the pair of registration rollers 42. The feed roller 41*a* is concentrically secured to a rotary shaft 41A extending in the left-right direction. The rotary shaft 41A is rotatably supported at a bearing section 17 formed at the body 10. The eccentric cams 41B are secured to respective end portions of the rotary shaft 41A.

Figure 13:
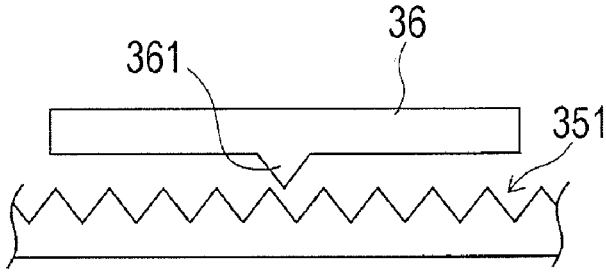
FIG. 13 is a side view of the slide plate and a grooved portion.

Left and right side plates 352 extending in the front-back direction are provided at a central portion in a widthwise direction of the sheet placement surface 31B of the sheet loading plate 31. A grooved portion 35 is formed between the side plates 352. A slide plate (moving member) 36 that is capable of sliding in the front-back direction along the grooved portion 35 is incorporated in the grooved portion 35. As shown in FIG. 13, a first rack (first engaging section) 351 having alternately and continuously formed protrusions and recesses and extending in the front-back direction is formed at a bottom portion of the grooved portion 35, whereas a first engaging pawl 361 that is capable of engaging the protrusions of the first rack 351 is formed at the lower surface of the slide plate 36.

When the slide plate 36 is moved by a force that is equal to or greater than a predetermined force, the slide plate 36 slides along the grooved portion 35 while a tactile feel is generated as a result of the first engaging pawl 361 moving over the protrusions of the first rack 351. The slide plate 36 is slidable from a front end portion to a back end portion of the grooved portion 35. A range of movement of the slide plate 36 is regulated by causing the slide plate 36 to abut upon stoppers 353 provided at a front end and a back end of the grooved portion 35, respectively.

Figure 4A:
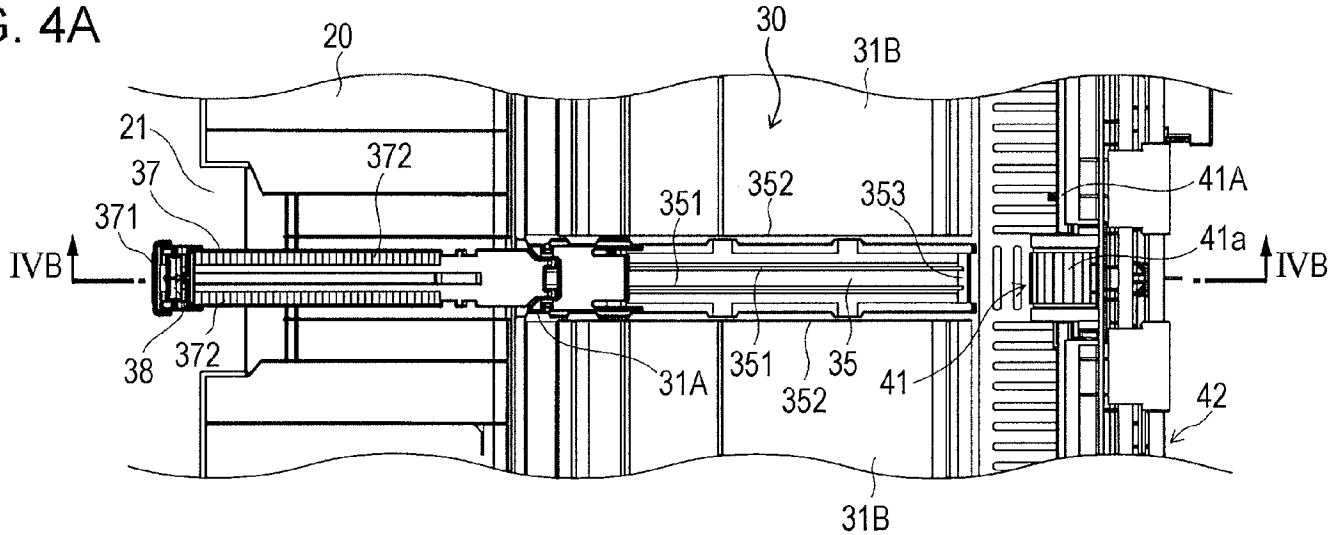
FIG. 4A is a plan view of a portion of FIG. 3.
Figure 4B:
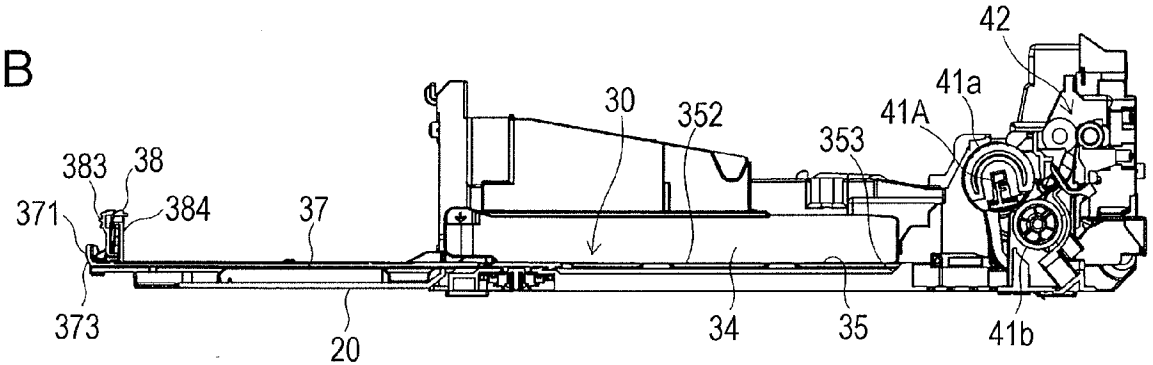
FIG. 4B is a sectional view taken along an arrow IVB-IVB of FIG. 4A.
Figure 5:
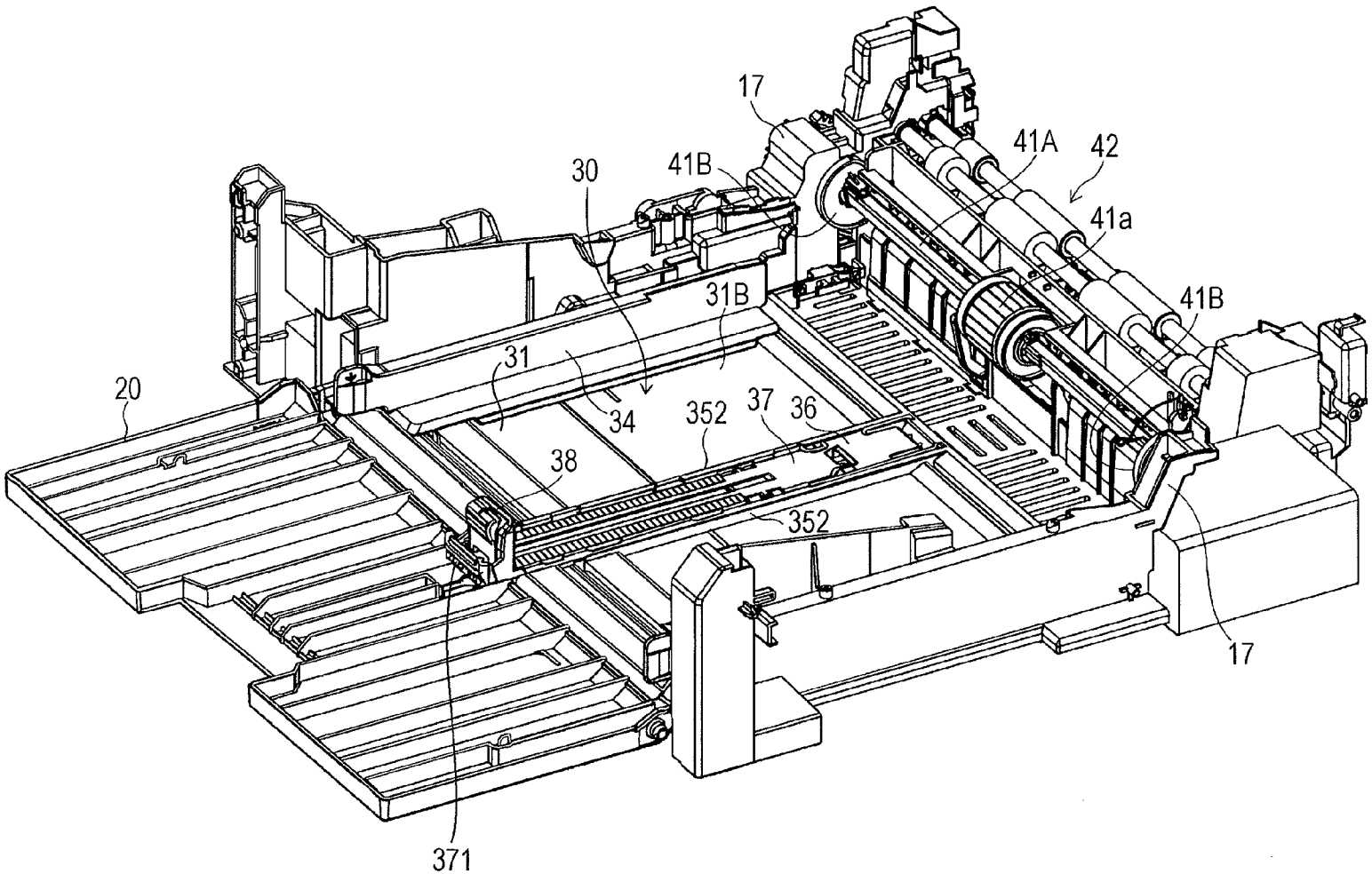
FIG. 5 is a perspective view of the bottom portion of the printer, and shows a state in which the cover is open, and the arm and the slide plate are disposed at frontmost positions, and an end guide is disposed at a backmost position.
Figure 6A:
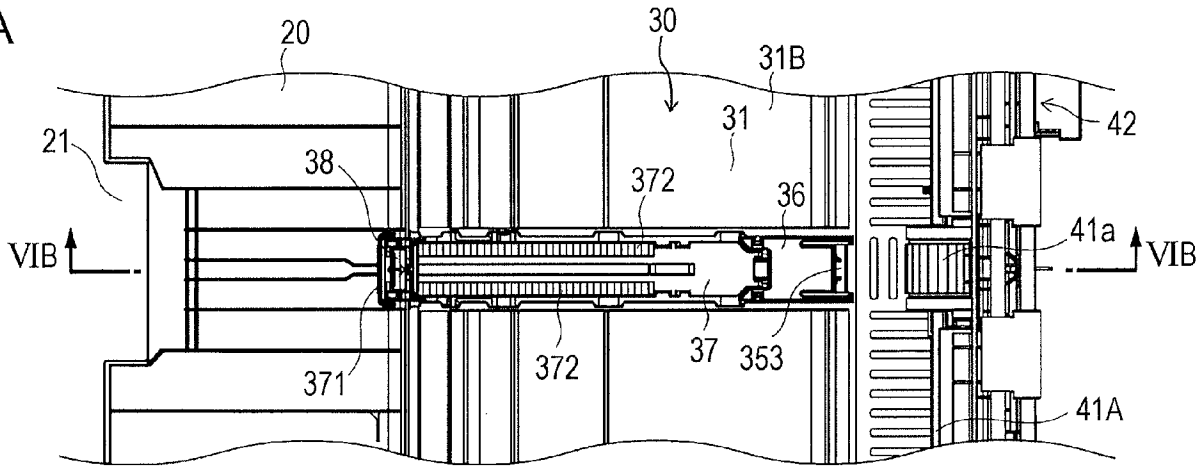
FIG. 6A is a plan view of a portion of FIG. 5.
Figure 6B:
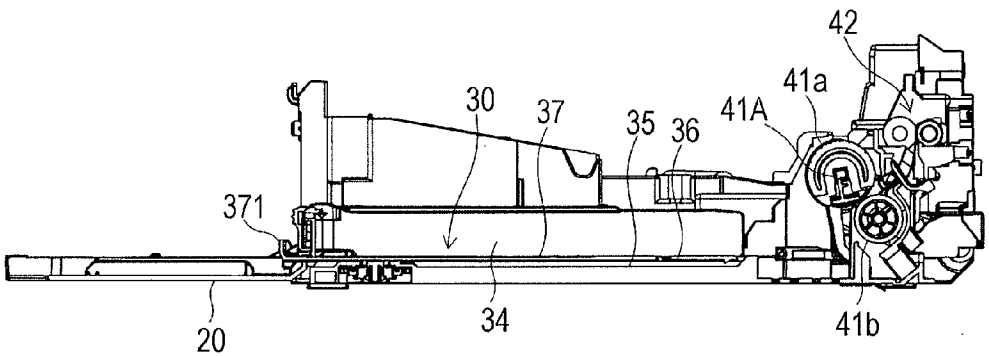
FIG. 6B is a sectional view taken along an arrow VIB-VIB of FIG. 6A.
Figure 11:
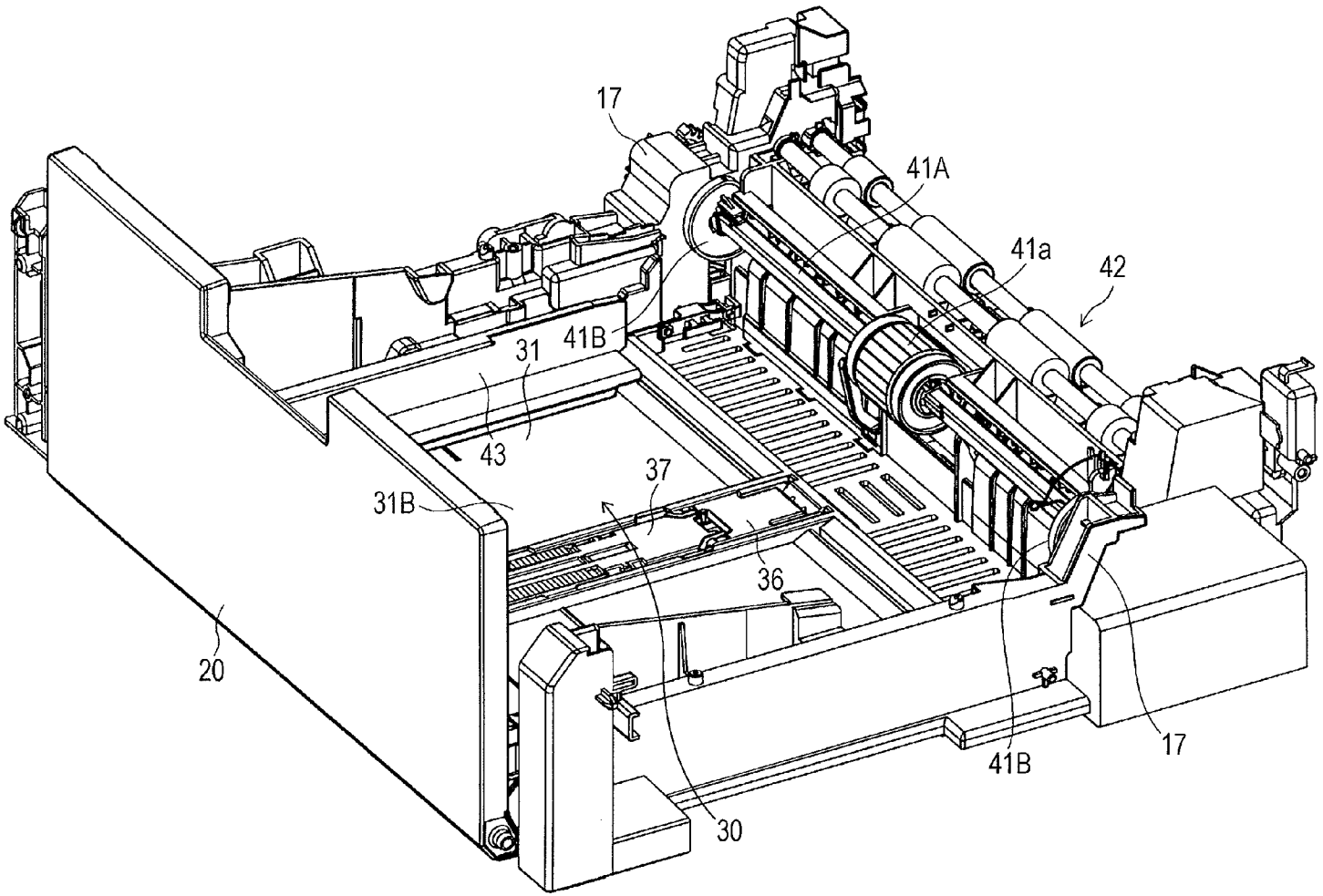
FIG. 11 is a perspective view of the bottom portion of the printer, and shows a state in which the cover is closed.
Figure 12A:
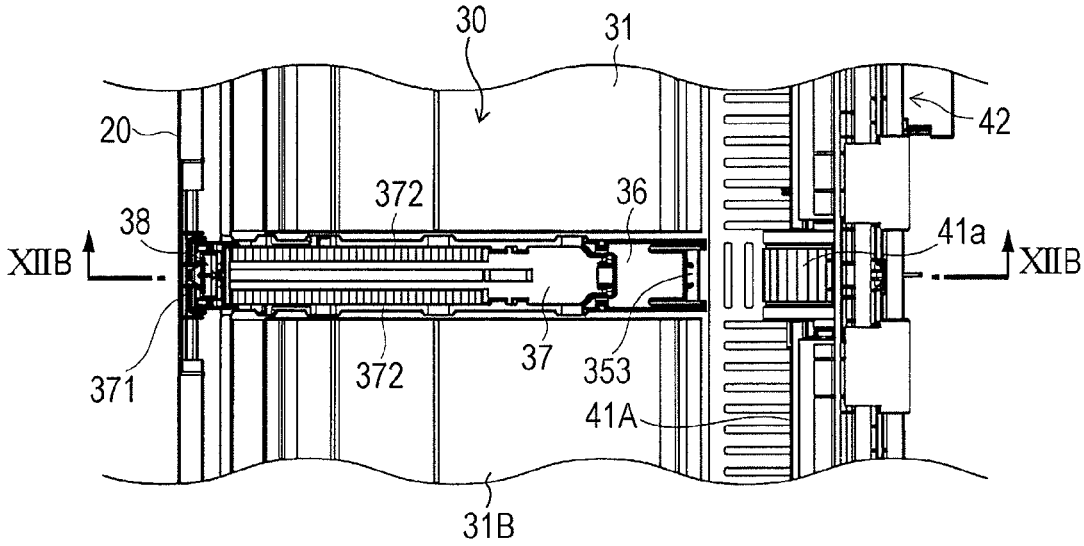
FIG. 12A is a plan view of a portion of FIG. 11.
Figure 12B:
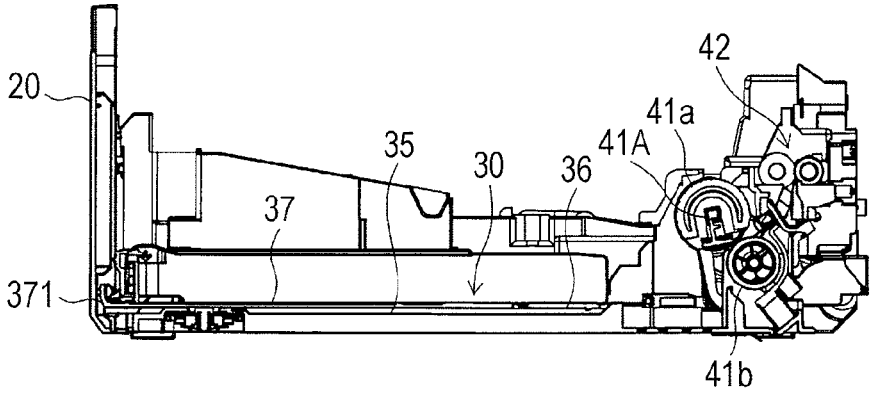
FIG. 12B is a sectional view taken along an arrow XIIB-XIIB of FIG. 12A.

A front end portion of an arm (linking member) 37 extending in a longitudinal direction of the grooved portion 37 is rotatably linked to a back end portion of the slide plate 36 through a rotary shaft 37A that is parallel with a hinge shaft 20A of the cover 20. An upwardly standing gripping portion 371 is formed at a back end portion of the arm 37. FIGS. 3 and 4A and 4B each show a state in which, while the cover 20 is completely open, the arm 37 is drawn out towards the back and the slide plate 36 is positioned at its backmost position. At this time, the arm 37 is placed on the inner surface of the open cover 20. The arm 37 is slidable in the front-back direction along with the slide plate 36. As shown in FIGS. 5 and 6A and 6B, when the slide plate 36 is disposed at its frontmost position, the arm 37 is disposed in the grooved portion 35, so that, as shown in FIGS. 11 and 12A and 12B, the cover 20 is capable of being closed. Even if the arm 37 is disposed in the grooved portion 35, the arm 37 is rotatable upward around the rotary shaft 37A as a fulcrum.

When the cover 20 is opened and the arm 37 is drawn out towards the back, the arm 37 moves along the inner surface of the cover 20. As shown in FIGS. 3 and 4A and 4B, when the slide plate 36 is positioned at its backmost position, the gripping section 371 at the back end of the arm 37 is positioned slightly towards the back from an upper end portion of the cover 20. A cutaway portion 21 for opening the cover 20 with one's hand is formed in a central portion of the upper end portion of the cover 20.

Figure 7:
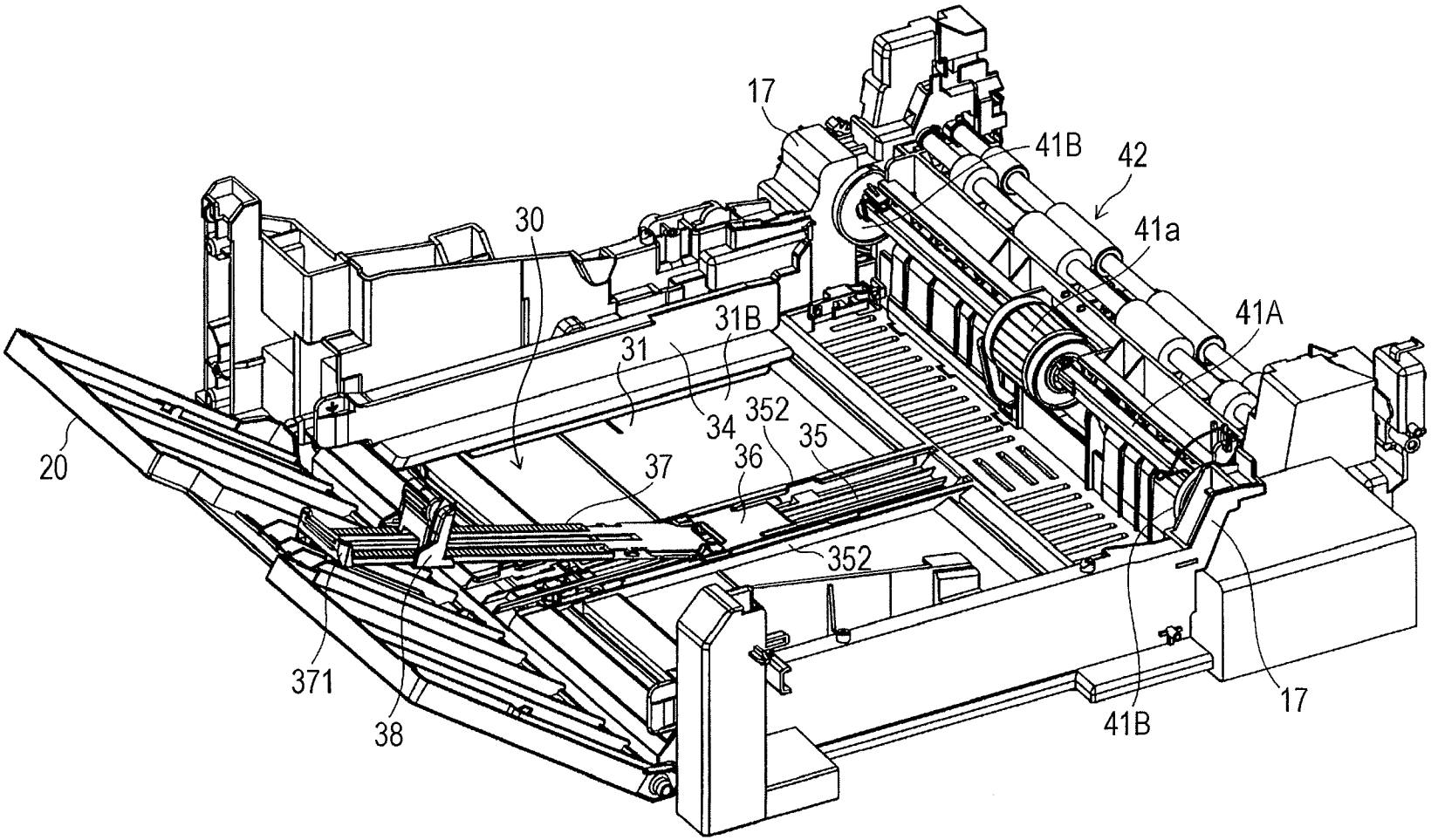
FIG. 7 is a perspective view of the bottom portion of the printer, and shows a state in which the arm is rotated when closing the cover.
Figure 8A:
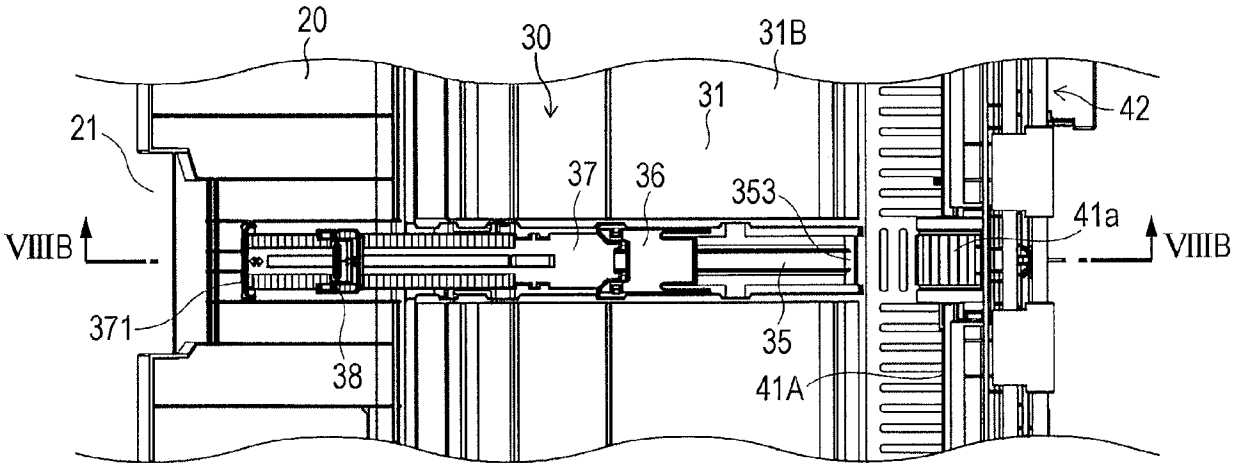
FIG. 8A is a plan view of a portion of FIG. 7.
Figure 8B:
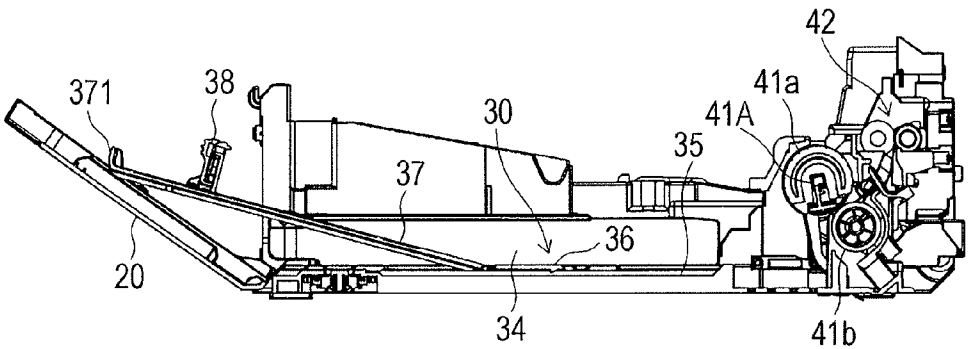
FIG. 8B is a sectional view taken along an arrow VIIIB-VIIIB of FIG. 8A.

As shown in FIGS. 7 and 8A and 8B, if the cover 20 is closed while the slide plate 36 is positioned in the grooved portion 35, the arm 37 is rotated upward with respect to the rotary shaft 37A as a fulcrum by the cover 20, and is rotated upward along with the cover 20. At this time, a lower portion of the back surface of the gripping section 371 at the back end portion of the arm 37 rotates upward while opposing and contacting and sliding along the inner surface of the cover 20. The lower portion of the back surface of the gripping section 371 that contacts and slides along the inner surface of the cover 20 is formed as a curved surface 373 that is in accordance with a direction of rotation of the arm 37 itself.

Figure 15A:
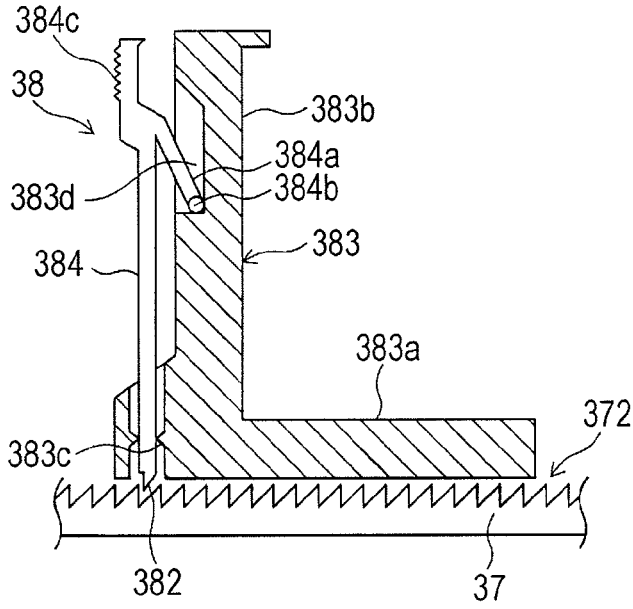
FIGS. 15A and 15B are each a side view of the end guide, with FIG. 15A showing a state in which a second engaging pawl engages a second rack, so that the end guide is incapable of retreating, and FIG. 15B showing a state in which the second engaging pawl is disengaged from the second rack, so that the end guide is capable of retreating.
Figure 15B:
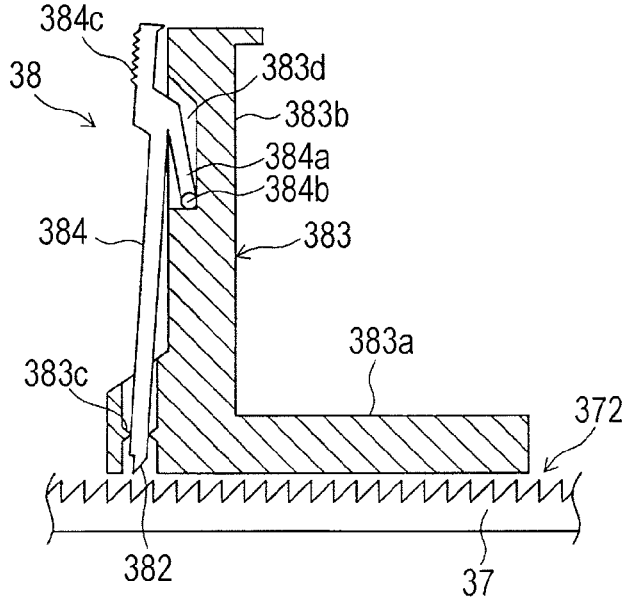

As shown in FIGS. 15A and 15B, a second rack (second engaging section) 372 extending in a longitudinal direction of the arm 37 is formed in a predetermined area of the upper surface of the arm 37 extending forwardly from the gripping section 371. An end guide (sheet back-edge regulating member) 38 that is slidable along the second rack 372 in the front-back direction is mounted to the arm 37. The end guide 38 includes a guide plate section 383 and a disengaging lever (engaging pawl disengaging unit, disengaging member) 384. The guide plate section 383 has an L shape in side view, and has a gripping section 383*b* standing upward from the back end of a base portion 383*a* slidably fitted to the arm 37. The disengaging lever 384 is mounted to the back side of the gripping section 383*b* of the guide plate section 383.

A lower end portion of the disengaging lever 384 is inserted into a narrow portion 383*c* and is movable in the up-down direction. The narrow portion 383*c* is formed at the front side of a lower end portion of the guide plate section 383. A second engaging pawl 382 having an inclined surface that is inclined backward as the front surface extends backward is formed at the lower end of the disengaging lever 384. A supporting portion 384*a* extending forwardly and downwardly is formed at the front surface of an upper end portion of the disengaging lever 384. The supporting portion 384*a* is inserted in a recess 383*d* that is formed in the back surface of the gripping section 383*b* while a lower end 384*b* is in contact with the recess 383*d*. A push section 384*c* is formed in the back surface of the upper end portion of the disengaging lever 384.

In the end guide 38, if the push section 384*c* of the disengaging lever 384 is pushed forward, as shown in FIG. 15B, the disengaging lever 384 is such that the supporting portion 384*a* rotates clockwise around the lower end 384*b* as a fulcrum, and the lower end portion of the disengaging lever 384 moves upward because the lower end portion of the disengaging lever 384 is regulated by the narrow portion 383*c*. At this time, the second engaging pawl 382 moves out of a recess of the second rack 372, and is disengaged, thereby making it possible for the end guide 38 to slide in the front-back direction along the arm 37. The push section 384*c* of the disengaging lever 384 is capable of being pushed forward by gripping the gripping section 383*b* and the push section 384*c*. If a push force of the push section 384*c* is removed, the disengaging lever 384 rotates counterclockwise from a state shown in FIG. 15B, and moves downward as shown in FIG. 15A because its lower end portion is regulated by the narrow portion 383*c*. This causes the second engaging pawl 382 to moved into and engage a recess of the second rack 372.

A force that causes the second engaging pawl 382 to engage the second rack 372 is set so as to be stronger than a force that causes the first engaging pawl 361 of the slide plate 36 to engage the first rack 351 at the bottom portion of the grooved portion 35. Therefore, if the end guide 38 is pushed forward while the second engaging pawl 382 of the disengaging lever 384 is engaged with the second rack 372 (the state shown in FIG. 15B), the arm 37 moves forward, so that the slide plate 36 is pushed forward. Consequently, it is possible to slide the slide plate 36 using the end guide 38, thereby making the apparatus easy to use.

When the slide plate 36 contacts the stopper 353 as a result of pushing the slide plate 36 forward, and is no longer capable of sliding further forward, the end guide 38 is forwardly slidable without pushing the disengaging lever 384. This is because the front surface of the second engaging pawl 382 is an inclined surface that is inclined towards the back as it extends downward. That is, when the end guide 38 is pushed forwardly without pushing the disengaging lever 384, the inclined surface of the second engaging pawl 382 moves on the inclined surface of the second rack 372 and moves over a protrusion thereof, so that the end guide 38 slides forward along the arm 37. Here, the end guide 38 is forwardly slidable while a tactile feel is generated as a result of the second engaging pawl 382 moving over the protrusions of the second rack 372. In order to push the end guide 38 forwardly without pushing the disengaging lever 384, the gripping section 383*b* of the guide plate section 383 is pushed. As shown in FIG. 15B, when the second engaging pawl 382 engages the second rack 372, backward movement of the end guide 38 is regulated as along as it is not disengaged by the disengaging lever 384.

Figure 14:
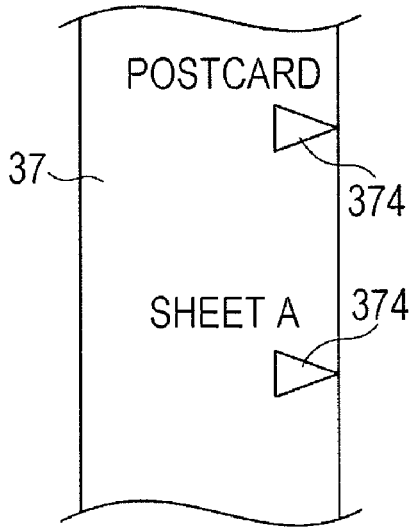
FIG. 14 is a partial plan view of the arm having marks indicating sheet sizes.

As shown in FIG. 14, marks (sheet size indicators) 374 indicating various sizes of sheets P supplied to the feed tray 30 are formed on the upper surface of the arm 37 so as to be separated from each other in a longitudinal direction. Any mark 374 is capable of being formed. For example, a mark is formed to indicate a small size such as a postcard size. In a state in which the end guide 38 is aligned with the mark 374 and the arm 37 is slid forwardly until the slide plate 36 abuts upon the front stopper 353, the interval from the standing plate section 32 to the end guide 38 is set so as to correspond to a sheet size length corresponding to the mark 374 with which the end guide 38 is aligned.

(3) Operation of Feed Tray and Advantages Resulting Therefrom

As described above, the sheets P that are set on the feed tray 30 are subjected to an image forming operation (that is, printing) while transporting the sheets P along the sheet transport path 40. The sheets P are set on the feed tray 30 while the front edges (in a draw-out direction) of the sheets P abut upon the standing plate section 32 and the end guide 38 abuts upon the back edges (in the draw-out direction) thereof so as to regulate backward shifting of the sheets P at all times. Since the sheets P are not shifted backward due to the end guide 38, the sheets P are reliably transported into the sheet transport path 40 by the sheet draw-out section 41. A method of setting sheets P on the feed tray 30 and operational advantages when large sheets whose back edges are placed on the open cover 20 are set, and a method of setting sheets P on the feed tray 30 and operational advantages when small sheets that fit within the back side in the body 10 are set will hereunder be described.

The large sheets are set in the following way. The cover 20 is opened and set horizontally. Then, the gripping section 371 is gripped to slide the arm 37 backwards. Then, as shown in FIGS. 3 and 4A and 4B, the slide plate 36 is disposed at its backmost position. Then, the end guide 38 is slid to the back end of the arm 37. From this state, the large sheets are inserted into the space 15 from the sheet supply opening 12A, are placed on the sheet placement surface 31B of the sheet loading plate 31, are inserted until their edges abut upon the standing plate section 32, and are loaded on the sheet placement surface 31B as a whole.

Then, the end guide 38 is slid forwardly, and abuts upon the back edges of the sheets. The end guide 38 is slid forwardly by sliding the end guide 38 forwardly along the arm 37 or by gripping the gripping section 371 and sliding the whole arm 37 forwardly. This causes the large sheets to be set on the feed tray 30 while preventing the large sheets from being shifted forwardly by causing the back edges of the large sheets to abut upon the end guide 38.

Figure 9:
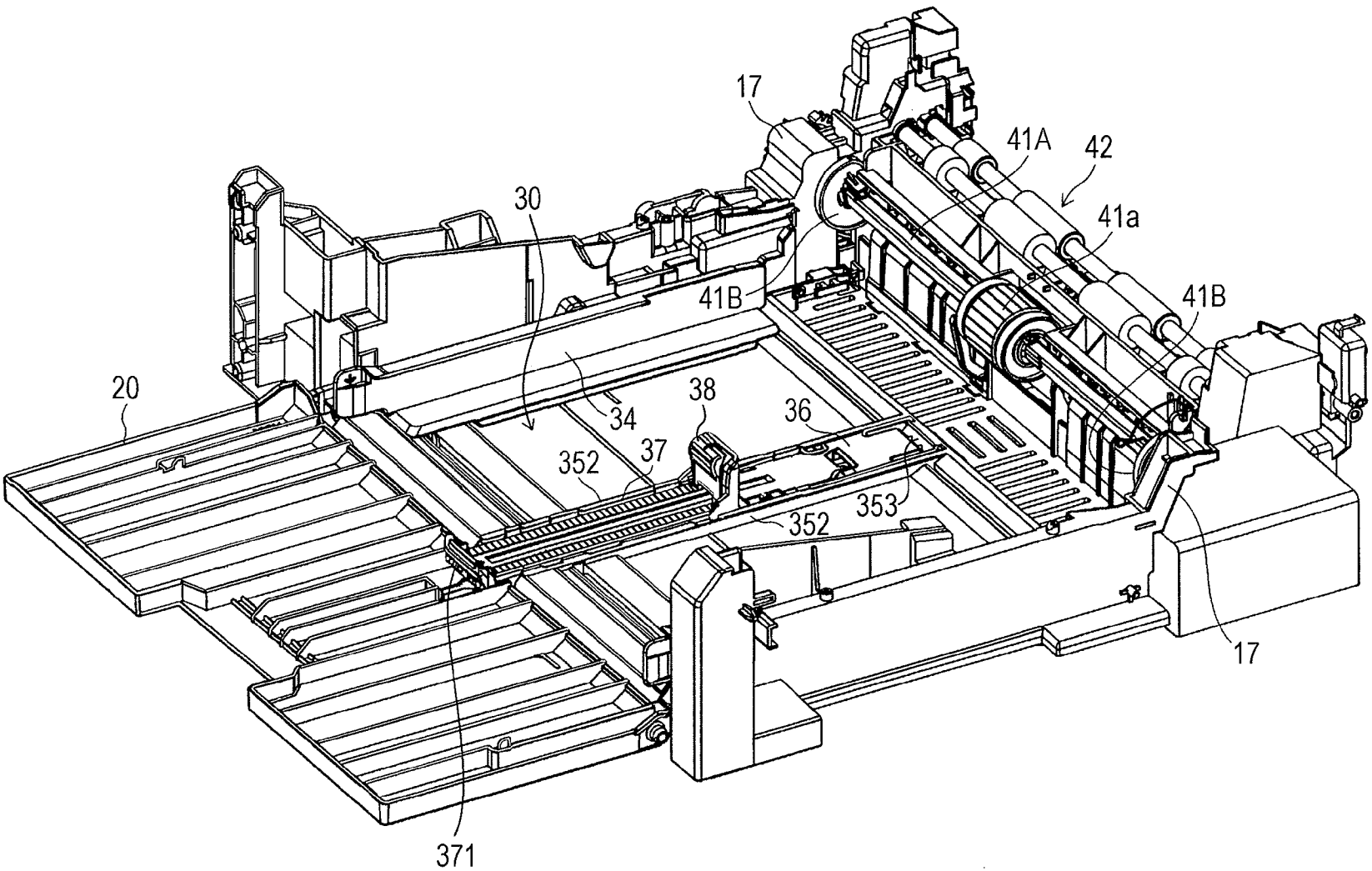
FIG. 9 is a perspective view of the bottom portion of the printer, and shows a state in which the cover is open, and the end guide on the arm, disposed at the frontmost position, is positioned at an intermediate position of the arm.
Figure 10A:
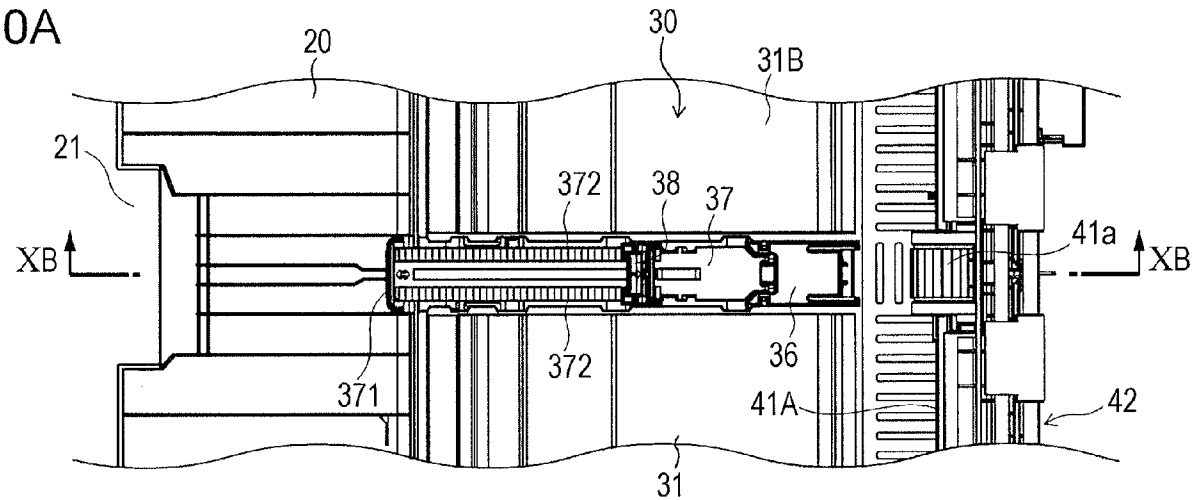
FIG. 10A is a plan view of a portion of FIG. 9.
Figure 10B:
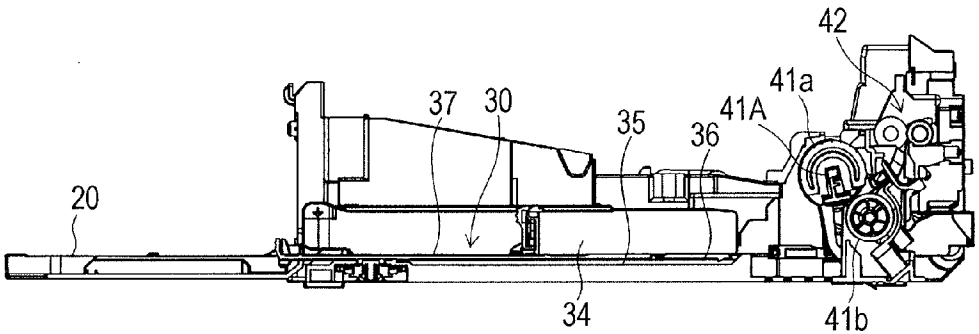
FIG. 10B is a sectional view taken along an arrow XB-XB of FIG. 10A.

Next, small sheets are set in the following way. The cover 20 is opened and set horizontally. Then, the gripping section 371 is gripped to slide the arm 37 and the end guide 38 backwards. Then, the small sheets are placed at the front side of the end guide 38. Then, while forwardly sliding the end guide 38 along the arm 37 and causing the end guide 38 to abut upon the back edges of the small sheets, the end guide 38 is positioned to a mark 374 indicating the corresponding sheet size. Next, from this state, the arm 37 is slid backwards until the edges of the sheets abut upon the standing plate section 32. By this, the small sheets are set on the feed tray 30 while preventing the small sheets from being shifted forwardly by causing the back edges of the small sheets to abut upon the end guide 38. FIGS. 9 and 10A and 10B each show exemplary positions of the arm 37 and the end guide 38 when such sheets are set.

According to the feed tray 30 in the exemplary embodiment, when the small sheets that may move into the back side of the feed tray 30 when they are set are set, the end guide 38 is forwardly slid to the mark 374 indicating the sheet size after temporarily setting the small sheets at the front side of the arm 37 drawn out towards the back. Then, by forwardly sliding the arm 37, the small sheets is capable of being set. Therefore, even when the space 15 above the feed tray 30 is narrow, the small sheets is capable of being set on the feed tray 30.

The cover 20 may be closed while the arm 37 is drawn out towards the back and is placed on the cover 20. However, here, since the arm 37 rotates along with the cover 20 around the rotary shaft 37A as a fulcrum, damage to the arm 37, such as bending or breakage of the arm 37, does not occur, thereby making the apparatus safe to use. In particular, the gripping section 371 at the back end of the arm 37 may rotate while contacting and sliding along the inner surface of the cover 20. However, since the lower portion of the back surface of the gripping section 371 opposing the inner surface of the cover 20 is formed into the curved surface 373 that is in accordance with the direction of rotation of the arm 37 itself, the gripping section 371 properly slides along with the cover 20. As a result, the arm 37 rotates smoothly so as not to prevent an opening/closing operation of the cover 20.

In the body 10, the arm 37 slides in the front-back direction while the arm 37 is disposed in the grooved portion 35. Therefore, the arm 37 is infrequently shifted in a lateral direction, thereby making it possible to correctly slide the arm 37 and the end guide 38 in the front-back direction.

The end guide 38 is slid by gripping the gripping section 383*b* and the disengaging lever 384 and forwardly pushing the push section 384*c*. In other words, as the end guide 38 is gripped and slid, the push section 384*c* of the disengaging lever 384 is naturally pushed, so that the second engaging pawl 382 is capable of being disengaged from the second rack 372. Accordingly, a mechanism that is easy to use is provided.

Further, since the marks 374 indicating the sheet sizes are formed on the arm 37, while the arm 37 is forwardly slid towards a user, the end guide 38 is aligned with the corresponding mark 374, so that small sheets is easily settable to predetermined positions.

Although the image forming apparatus according to the exemplary embodiment is described using an electrophotographic image forming apparatus as an example, the present invention is applicable to other types of image forming apparatuses including image forming units, such as inkjet image forming units.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding device comprising:

a body having a first sheet placement surface on which a sheet that is to be fed is placed;

a cover rotatably provided at the body, the cover having a second sheet placement surface capable of supporting a back edge portion in a feeding direction of the sheet when the cover is open, the cover being provided with a rotary shaft, the sheet being placed on the first sheet placement surface;

a moving member provided at the first sheet placement surface so as to be movable in line with the first sheet placement surface in a direction that is parallel to the feeding direction;

a linking member extending in a direction of movement of the moving member from the moving member, one end portion of the linking member being rotatably linked to the moving member using a second rotary shaft that is parallel to the rotary shaft of the cover; and a sheet back-edge regulating member provided at the linking member so as to be movable in the direction of movement of the moving member, the sheet back-edge regulating member regulating a back edge in the feeding direction of the sheet placed on the first sheet placement surface, wherein the first sheet placement surface has a first engaging section extending in the direction of movement of the moving member, wherein the moving member has a first engaging pawl that is capable of engaging the first engaging section, wherein the linking member has a second engaging section extending in a longitudinal direction of the linking member, wherein the sheet back-edge regulating section has a second engaging pawl and an engaging pawl disengaging unit, the second engaging pawl being capable of engaging the second engaging section, the engaging pawl disengaging unit disengaging the second engaging pawl from the second engaging section, and wherein a force that causes the second engaging pawl to engage the second engaging section is stronger than a force that causes the first engaging pawl to engage the first engaging section.

2. The feeding device according to claim 1, further comprising a gripping section provided at another end portion of the linking member opposite to the one end portion of the linking member.

3. The feeding device according to claim 2, wherein a surface of the another end portion of the linking member facing the cover is formed into a curved surface that is in accordance with a direction of rotation of the linking member.

4. The feeding device according to claim 1, wherein the first sheet placement surface has a grooved portion in which the linking member extending in the direction of movement is disposed.

5. The feeding device according to claim 1, wherein the engaging pawl disengaging unit includes a disengaging member that disengages the second engaging pawl from the second engaging section by moving in a direction of movement the sheet back-edge regulating section.

6. The feeding device according to claim 1, wherein the linking member has a sheet size indicator that is in correspondence with the back edge of the sheet.

7. An image forming apparatus comprising:

an image forming section that forms an image; and the feeding device of claim 1.

8. The feeding device according to claim 1, wherein the first sheet placement surface has a grooved portion, wherein the linking member is configured to be disposed in the grooved portion, if the moving member is disposed at a frontmost position in the direction that is parallel to the feeding direction, and wherein the linking member is configured to be drawn out of the grooved portion, if the moving member is disposed at a backmost position in the direction that is parallel to the feeding direction.

9. The feeding device according to claim 1, wherein a length of the linking member in the direction of movement of the moving member is longer than a length of the cover in the direction of movement of the moving member.

10. A feeding device comprising:

a body having a first sheet placement surface on which a sheet that is to be fed is placed;

a cover rotatably provided at the body, the cover having a second sheet placement surface capable of supporting a back edge portion in a feeding direction of the sheet when the cover is open, the cover being provided with a rotary shaft, the sheet being placed on the first sheet placement surface;

a moving member provided at the first sheet placement surface so as to be movable in line with the first sheet placement surface in a direction that is parallel to the feeding direction;

a linking member extending in a direction of movement of the moving member from the moving member, one end portion of the linking member being rotatably linked to the moving member using a second rotary shaft that is parallel to the rotary shaft of the cover; and a sheet back-edge regulating member provided at the linking member so as to be movable in the direction of movement of the moving member, the sheet back-edge regulating member regulating a back edge in the feeding direction of the sheet placed on the first sheet placement surface wherein the linking member is configured to extend to a drawn-out position wherein the linking member extends across an entire length of the cover in the direction of movement of the moving member, if the moving member is disposed at a backmost position in the direction that is parallel to the feeding direction, and wherein the linking member is configured to rotate upward from the drawn-out position, along with the cover, with the second rotary shaft as a fulcrum, as the cover is moved from an open position to a closed position.

* * * * *